US009050495B2

(12) United States Patent
Sieben

(10) Patent No.: US 9,050,495 B2
(45) Date of Patent: Jun. 9, 2015

(54) CORE EXERCISE BAR

(76) Inventor: Richard William Sieben, Calgary (CA)

( * ) Notice: Subject to any disclaimer, the term of this patent is extended or adjusted under 35 U.S.C. 154(b) by 0 days.

(21) Appl. No.: 13/600,203

(22) Filed: Aug. 30, 2012

(65) Prior Publication Data

US 2014/0045659 A1 Feb. 13, 2014

(30) Foreign Application Priority Data

Jul. 23, 2012 (CA) ..... 2783660

(51) Int. Cl.

| | |
|---|---|
| ***A63B 21/072*** | (2006.01) |
| ***A63B 21/075*** | (2006.01) |
| ***A63B 71/00*** | (2006.01) |
| *A63B 71/02* | (2006.01) |

(52) U.S. Cl.

CPC ..... *A63B 21/0728* (2013.01); *A63B 71/0036* (2013.01); *A63B 21/0724* (2013.01); *A63B 2071/025* (2013.01); *A63B 2210/50* (2013.01)

(58) Field of Classification Search

CPC ..... A63B 1/00; A63B 17/00; A63B 21/00; A63B 21/0004; A63B 21/0081; A63B 21/06; A63B 21/0615; A63B 21/072; A63B 21/0724; A63B 21/0726

USPC ..... 482/106, 107, 108, 140

See application file for complete search history.

(56) References Cited

U.S. PATENT DOCUMENTS

| | | | | | |
|---|---|---|---|---|---|
| 3,773,143 | A * | 11/1973 | Del Prete et al. | ..... | 182/214 |
| 4,830,364 | A * | 5/1989 | Wexler | ..... | 482/148 |
| 5,984,843 | A * | 11/1999 | Morton | ..... | 482/106 |
| 6,592,499 | B2 * | 7/2003 | Parker | ..... | 482/106 |
| 7,731,641 | B1 * | 6/2010 | Chen | ..... | 482/108 |
| 8,047,974 | B1 * | 11/2011 | Kanelos | ..... | 482/106 |
| 2005/0065003 | A1 * | 3/2005 | Klotzki | ..... | 482/107 |
| 2006/0073949 | A1 * | 4/2006 | Cao | ..... | 482/94 |
| 2006/0276314 | A1 * | 12/2006 | Wilson et al. | ..... | 482/106 |

* cited by examiner

*Primary Examiner* — Loan H Thanh
*Assistant Examiner* — Megan Anderson
(74) *Attorney, Agent, or Firm* — Kyle R. Satterthwaite; Ryan W. Dupuis; Ade & Company, Inc

(57) ABSTRACT

The core exercise bar is comprised of the main bar with one bar at each end that can retract into the main bar or extend outward with locking nuts at each end of the bar to hold them in place at each end of the retracting bars are threaded bolts that can be threaded in ward or outward at each end of the threaded bolts are brackets that pivot from side to side in an up and down motion with weighted rubber square handgrips attached to the brackets at each end.

4 Claims, 4 Drawing Sheets

CORE EXERCISE BAR

REFERENCE TO RELATED APPLICATIONS

This application claims priority under 35 U.S.C. 119(a) of Canadian Patent Application No. 2,783,660, filed Jul. 23, 2012.

BACKGROUND OF THE INVENTION

1. Field of the Invention

The present invention relates to a resistance exercise device and more particularly to an extendible and retractable bar having weighted handgrips.

2. Prior Art

U.S. Pat. No. 6,592,499 B2 discloses an apparatus that is used for exercising includes a barbell having a longitudinal axis and first and second axial ends. First and second dumbbells are releasably connectable to the first and second axial ends of the barbell. Each of the first and second dumbbells has weighted opposite ends portions and a handle extending between the weighted opposite end portions. Locking members releasably connect the first and second dumbbells to the first and second axial ends of the barbell so that longitudinal axes of the first and second dumbbells are coaxial with the longitudinal axis of the barbell. Each of the locking members has a locking position in which the dumbbells are connected to the barbell U.S. Pat. No. 7,887,469 B1 discloses an adjustable barbell or dumbbell or exercise device includes a handle, two carriers each having: a tubular member attached to the end portion of the handle and each having a number of slots, a number of weight members attachable onto the tubular member of the carrier, and two latch members each having a shank engaged into the tubular member and each having a number of latch tongues extendible out through the slots of the carrier for engagement with the weight members and for anchoring the weight members on the carrier and the handle, and the latch tongues are selectively engageable into the tubular member of the carrier for allowing the weight members to be attached to and disengaged from the carrier and the end portion of the handle.

US Pat. App. Pub. No. 2005/0065003 relates to a new design for a dumbbell with a dumbbell handle element and at least one holder for removable fastening of one or more weight disks on one end of the dumbbell element.

US Pat. App. Pub. No. 2006/0073949 A1 discloses a protective shield for the weight plate and lifting bar of fitness equipment, so that the coating layer on both the weight plate and lifting bar will not be damaged, scratched or scraped off, due to the intended adding or removing of weight plates.

US Pat. App. Pub. No. 2006/0276314 A1 discloses an elongate bar having sliding handgrips concentrically mounted thereon adapted for use with various types of resistance-type exercise devices. In a preferred embodiment, the handgrips, which are constrained to move only in an axial direction with respect to the bar, are interconnected on an inner bar-facing portion of the handgrips by linking means such as belts, in such a manner that the handgrips and bar retain a low profile, and the handgrips are equidistant from the center of the bar throughout their axial range of motion. In the preferred embodiment, the linking means are belts that are supported by pulleys housed within recesses in the bar and rotatably attached thereto. Embodiments of the bar for performing various exercises are disclosed which include resistive forces attachment means affixed to the bar operable for attaching weights, lever arms, springs, cable(s), exerciser's own body weight to provide a resistive force for exercising a variety of muscles.

US Pat. App. Pub. No. 2012/0077650 A1 discloses a friction-based exercise device. Contemplated exercise devices comprise a segmented shaft having one or more longitudinal patterns running the length of the shafts or shaft segments. Cylindrical sliders can be slid onto the shaft where an interior surface of the slider comprises a complimentary pattern to and frictionally engages with the longitudinal pattern of the shaft. When under a gripping force of a user, the sliders flex inward toward the shaft and increases friction resistance as the user slides the sliders along the shaft.

SUMMARY OF THE INVENTION

It is the object of the present invention to provide an exercise device and bar that can be adjusted to a desired length and weight with handgrips at each end.

According to one aspect of the invention, there is provided a core exercise bar comprising:

a bar having a hollow interior, an open first end, and an open second end lying opposite to the open first end;

a first extension arm telescopically connected to the bar through the first open end thereof, the first extension arm having an inner end slidably disposed within the hollow interior of the bar and an opposing outer end disposed outside the bar beyond the first open end thereof for extension and retraction of the outer end of the first extension arm relative to the first open end of the bar by sliding of the inner end of the first extension arm back and forth inside the hollow interior of the bar;

a second extension arm telescopically connected to the bar through the second open end thereof, the second extension arm having an interior end slidably disposed within the hollow interior of the bar and an opposing exterior end disposed outside the bar beyond the second open end thereof for extension and retraction of the exterior end of the second extension arm relative to the second open end of the bar by sliding of the internal end of the second extension arm back and forth inside the hollow interior of the bar;

a first set of internal threads inside the first extension arm;

a second set of internal threads inside the second extension arm;

a first retractable bolt extending into the first extension arm through the outer end thereof and threaded into the first set of internal threads inside said first extension arm, whereby the first retractable bolt can be extended from and retracted into the first extension arm by rotating the first retraction bolt in opposing directions;

a second retractable bolt extending into the second extension arm through the exterior end thereof and threaded into the second set of internal threads inside said second extension arm, whereby the second retractable bolt can be extended from and retracted into the second extension arm by rotating the second retraction bolt in opposing directions;

a first handgrip attached to the first retractable bolt at an end thereof disposed outside the first extension arm beyond the outer end thereof;

a second handgrip attached to the second retractable bolt at an end thereof disposed outside the second extension arm beyond the exterior end thereof;

a first locking clamp mounted to the bar adjacent the first open end thereof and operable to lock a position of the first extension arm relative to the bar; and a second locking clamp mounted to the bar adjacent the second open end thereof and operable to lock a position of the second extension arm relative to the bar.

DESCRIPTION OF THE PREFERRED EMBODIMENTS

One embodiment of the present invention is illustrated in the accompanying drawings, and features a hollow base bar 5 that is 1¼ inch in diameter, 30 inches long, weighing 4 lbs, and made of steel. A 12 inch extension arm (bar) 3 made of steel is provided at each end of the base bar 5, and weighs 1 lb. Each extension arm (bar) 3 can retract into the base bar 5 through a respective open end thereof, and extend out from the respective end of the base bar 5 by up to 11 inches.

Figure 1:
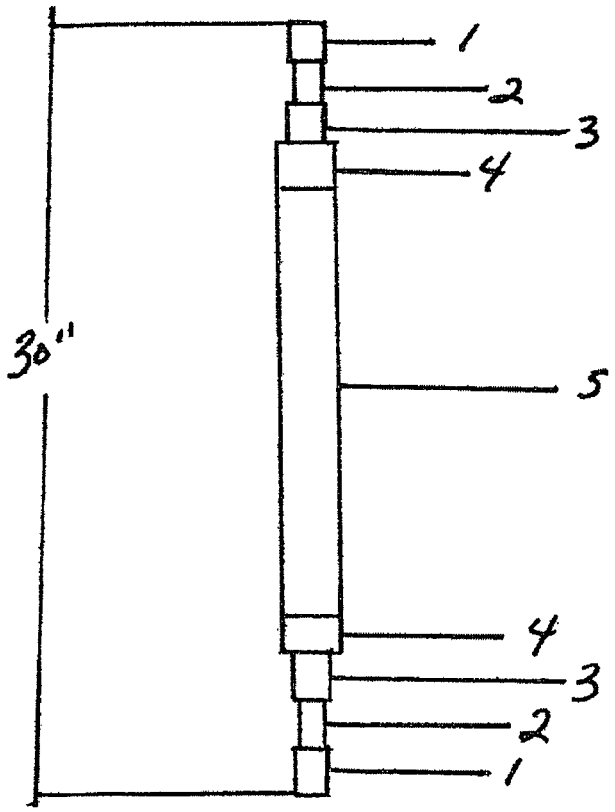
FIG. 1 is a side view of a core exercise bar of the present invention in a fully retracted state.
Figure 2:
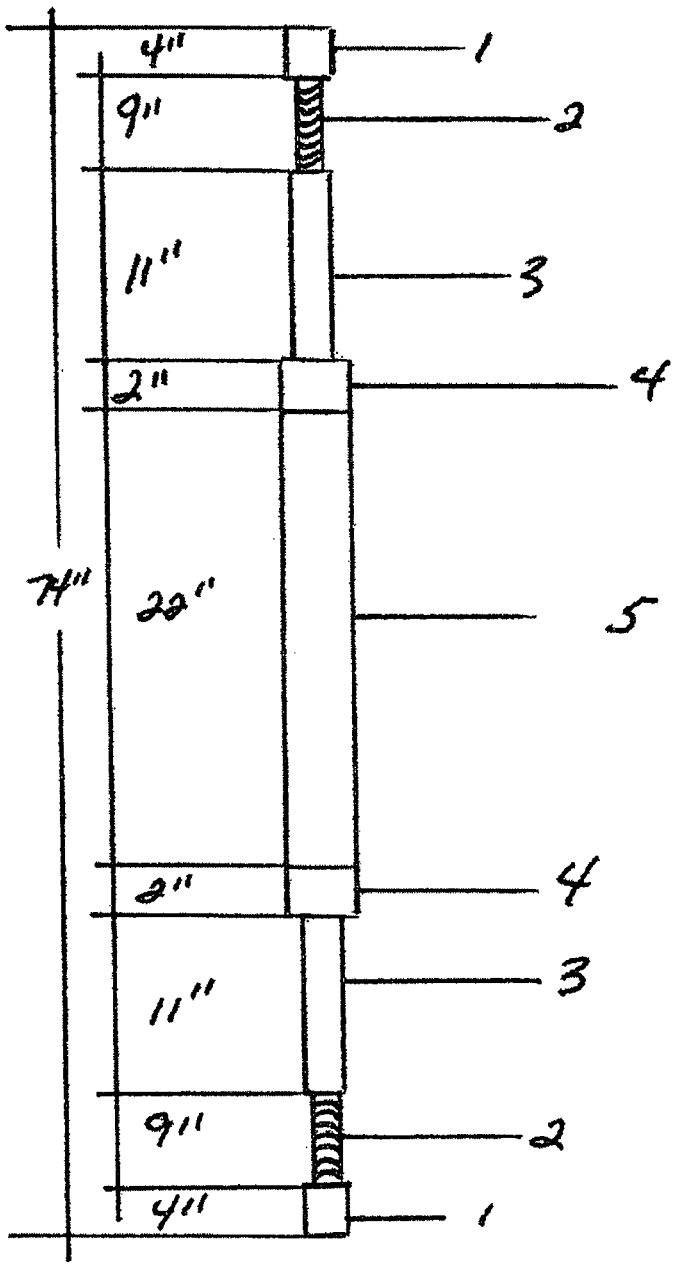
FIG. 2 is a side view of the core exercise bar in a fully extended state.
Figure 3:
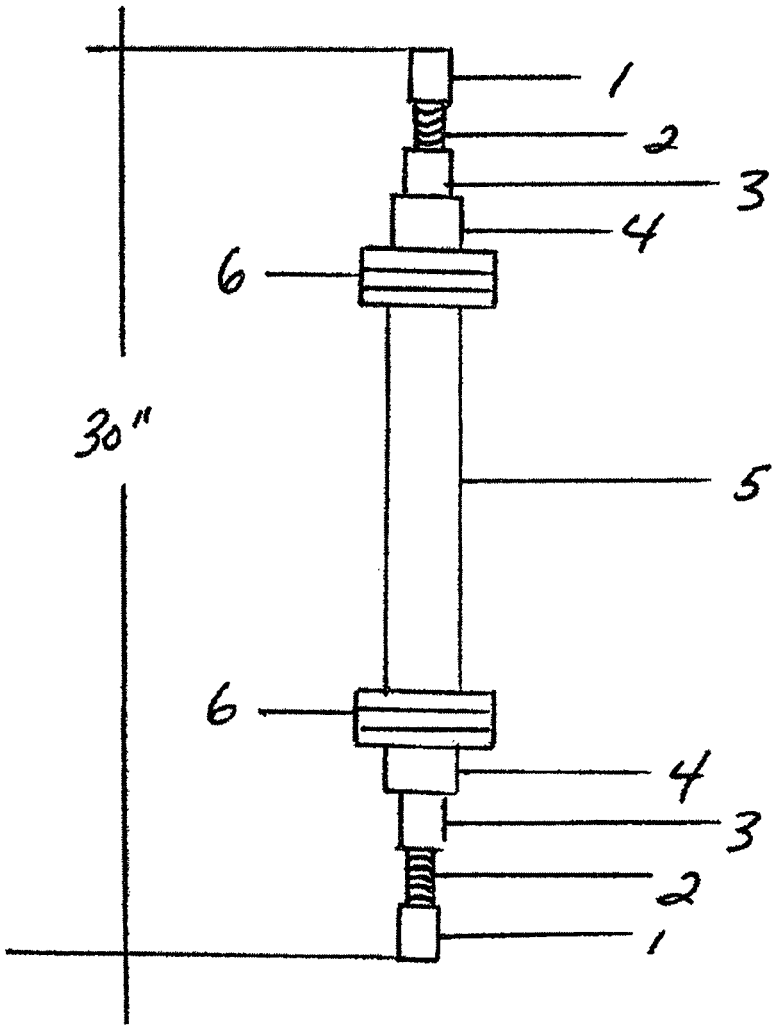
FIG. 3 is a side view of the core exercise bar with removable weights installed thereon.
Figure 4:
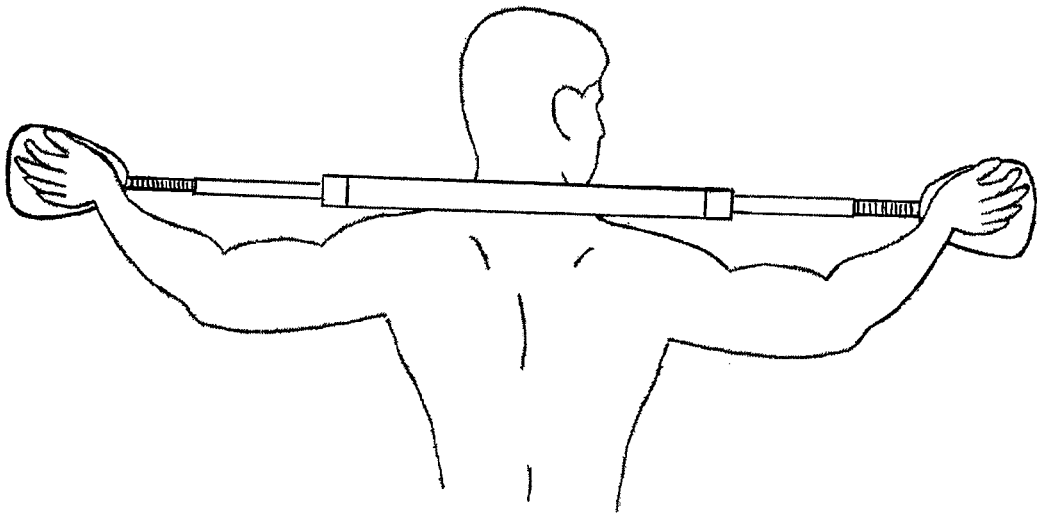
FIG. 4 is an elevational view showing one mode of use of the core exercise bar.

At an outer end of each extension arm (bar) 3 is a 9 inch long bolt 2 that can be screwed in or out of internal threads that are found inside the extension arm 3 so as to extend and retract the bolt relative to the extension arm by rotating the bolt in opposite directions. At the outer end of each 9 inch long bolt 2 is a weighted, adjustable hand grip 1 that attaches to the 9 inch long bolt 2. An additional barbell type weight 6 can be added to each end of the base bar 5. The Core Exercise Bar can retract to 30 inches, as shown in FIG. 1, and extend up to 74 inches, as shown in FIG. 2. Up to 32 lbs of weights 6 can be added, as shown in FIG. 3, thereby making a barbell of 40 lbs total weight.

In the preferred embodiment, each adjustable weighted hand grip 1 measures 4-inches, and a 1 lb or 2 lb weight may be used. The base bar 5 is covered in high density foam, and a 2-inch locking clamp 4 is provided at each end of the base bar 5 for selective locking of the telescopic position of the respective extension arm 3. The base bar 5 and extension arms 3 may be used on alone to form a 6 lb barbell, and up to three 5 lb weights 6 may be added at each end of the base bar, which together with weighted hand grips of 2 lbs each can achieve a total barbell weight of 40 lbs. The weights 6 may have hinges and locking clips for easy assembly thereof with the base bar 5.

The invention claimed is:

1. A core exercise bar comprising:

a bar having a hollow interior, an open first end, and an open second end lying opposite to the open first end;

a first extension arm telescopically connected to the bar through the open first end thereof, the first extension arm having an inner end slidably disposed within the hollow interior of the bar and an opposing outer end disposed outside the bar beyond the open first end thereof for extension and retraction of the outer end of the first extension arm relative to the open first end of the bar by sliding of the inner end of the first extension arm back and forth inside the hollow interior of the bar;

a second extension arm telescopically connected to the bar through the open second end thereof, the second extension arm having an interior end slidably disposed within the hollow interior of the bar and an opposing exterior end disposed outside the bar beyond the open second end thereof for extension and retraction of the exterior end of the second extension arm relative to the open second end of the bar by sliding of the internal end of the second extension arm back and forth inside the hollow interior of the bar;

a first set of internal threads inside the first extension arm;

a second set of internal threads inside the second extension arm;

a first retractable bolt extending into the first extension arm through the outer end thereof and threaded into the first set of internal threads inside said first extension arm, whereby the first retractable bolt can be extended from and retracted into the first extension arm by rotating the first retraction bolt in opposing directions;

a second retractable bolt-extending into the second extension arm through the exterior end thereof and threaded into the second set of internal threads inside said second extension arm, whereby the second retractable bolt can be extended from and retracted into the second extension arm by rotating the second retraction bolt in opposing directions;

a first handgrip attached to the first retractable bolt at an end thereof disposed outside the first extension arm beyond the outer end thereof;

a second handgrip attached to the second retractable bolt at an end thereof disposed outside the second extension arm beyond the exterior end thereof;

a first locking clamp mounted to the bar adjacent the open first end thereof and operable to lock a position of the first extension arm relative to the bar;

a second locking clamp mounted to the bar adjacent the open second end thereof and operable to lock a position of the second extension arm relative to the bar; and two weight members, each arranged for selective mounting on the bar in a detachable and re-attachable manner adjacent a respective one of the open first and second ends thereof;

wherein the weight members comprise hinges and locking devices for assembly of the weight members to the bar.

2. The core exercise device of claim 1 wherein the locking devices are locking clips.

3. A core exercise bar comprising:

a bar having a hollow interior, an open first end, and an open second end lying opposite to the open first end;

a first extension arm telescopically connected to the bar through the open first end thereof, the first extension arm having an inner end slidably disposed within the hollow interior of the bar and an opposing outer end disposed outside the bar beyond the open first end thereof for extension and retraction of the outer end of the first extension arm relative to the open first end of the bar by sliding of the inner end of the first extension arm back and forth inside the hollow interior of the bar;

a second extension arm telescopically connected to the bar through the open second end thereof, the second extension arm having an interior end slidably disposed within the hollow interior of the bar and an opposing exterior end disposed outside the bar beyond the open second end thereof for extension and retraction of the exterior end of the second extension arm relative to the open second end of the bar by sliding of the internal end of the second extension arm back and forth inside the hollow interior of the bar;

a first set of internal threads inside the first extension arm;

a second set of internal threads inside the second extension arm;

a first retractable bolt extending into the first extension arm through the outer end thereof and threaded into the first set of internal threads inside said first extension arm, whereby the first retractable bolt can be extended from and retracted into the first extension arm by rotating the first retraction bolt in opposing directions;

a second retractable bolt-extending into the second extension arm through the exterior end thereof and threaded into the second set of internal threads inside said second extension arm, whereby the second retractable bolt can be extended from and retracted into the second extension arm by rotating the second retraction bolt in opposing directions;

a first handgrip attached to the first retractable bolt at an end thereof disposed outside the first extension arm beyond the outer end thereof;

a second handgrip attached to the second retractable bolt at an end thereof disposed outside the second extension arm beyond the exterior end thereof;

a first locking clamp mounted to the bar adjacent the open first end thereof and operable to lock a position of the first extension arm relative to the bar;

a second locking clamp mounted to the bar adjacent the open second end thereof and operable to lock a position of the second extension arm relative to the bar; and two weight members each mounted on the bar in a detachable and re-attachable manner adjacent a respective one of the open first and second ends thereof;

wherein the weight members comprise hinges and locking devices assembling the weight members to the bar.

4. The core exercise device of claim 3 wherein the locking devices are locking clips.

* * * * *